US012630995B1

(12) United States Patent
Illi

(10) Patent No.: US 12,630,995 B1
(45) Date of Patent: May 19, 2026

(54) POSITIONABLE BUCKET ATTACHMENT

(71) Applicant: Nathan T. Illi, Troy, ID (US)

(72) Inventor: Nathan T. Illi, Troy, ID (US)

( * ) Notice: Subject to any disclaimer, the term of this patent is extended or adjusted under 35 U.S.C. 154(b) by 281 days.

(21) Appl. No.: 18/381,308

(22) Filed: Oct. 18, 2023

(51) Int. Cl.
*E02F 3/36* (2006.01)

(52) U.S. Cl.
CPC ..... *E02F 3/3677* (2013.01)

(58) Field of Classification Search
CPC ..... E02F 3/3677; E02F 3/3681
See application file for complete search history.

(56) References Cited

U.S. PATENT DOCUMENTS 4,779,364 A * 10/1988 Holmdal ..... E02F 3/3681 37/468
5,515,626 A * 5/1996 Holscher ..... E02F 3/3677 37/468
6,862,822 B1 * 3/2005 Masse ..... E01B 27/04 37/104
9,587,371 B1 3/2017 Hostetler
11,466,424 B2 10/2022 Beaudoin et al.
12,421,687 B2 * 9/2025 Cottingham ..... E02F 3/3659
2002/0066215 A1 * 6/2002 Kaczmarski ..... E02F 3/3627 37/468
2005/0095109 A1 5/2005 Harris
2005/0229445 A1 10/2005 Poquette
2015/0240456 A1 * 8/2015 Jonsson ..... E02F 3/3627 701/50
2018/0080191 A1 3/2018 Nair et al.
2021/0062454 A1 3/2021 Bergeron
2021/0095441 A1 * 4/2021 Jonsson ..... E02F 3/3681
2022/0018088 A1 1/2022 Petro et al.

FOREIGN PATENT DOCUMENTS

CA 3152666 A1 10/2022

* cited by examiner

*Primary Examiner* — Saul Rodriguez
*Assistant Examiner* — Brendan P Tighe
(74) *Attorney, Agent, or Firm* — Cramer Patent & Design, PLLC.; Aaron R. Cramer

(57) ABSTRACT

A positionable bucket attachment is a device that allows the digging bucket on a machine such as an excavator to be pivoted at different angles without removing the bucket from the machine. The device may be located between the distal end of the digging arm and the bucket itself. The device provides a pivoting plate that functions as a reversible quick coupling and may be approximately eighteen inches tall, fourteen inches wide, and twelve inches deep. Adjustments in pivoting angle are made with a bolt that will fit in one of fourteen different holes arranged in a circular pattern. The device may allow a user to flip the bucket up to one-hundred-eighty-degrees or cam it to dig at different degrees.

2 Claims, 11 Drawing Sheets

POSITIONABLE BUCKET ATTACHMENT

RELATED APPLICATIONS

Non-applicable.

FIELD OF THE INVENTION

The presently disclosed subject matter is directed to a bucket attachment and more specifically to a positionable bucket attachment.

BACKGROUND OF THE INVENTION

Excavators are used in a variety of settings, from busy roadway projects and construction sites to mines and quarries, military bases, industrial facilities, farms, and anywhere else where large amounts of earth need to be efficiently excavated. These construction and earthmoving workhorses are essential for accuracy and speedy digging.

Although effective, excavators have limitations. Their design is a major obstacle. Excavators use linear motion of their digging arms to expand or retract and curl the bucket inwards or outwards, unlike other machinery. This design is efficient for various activities but cannot pivot the bucket.

When exact digging and parallel alignment to the arm's travel route are needed, this constraint is crucial. Lack of a pivoting or positionable bucket mechanism can complicate operations in congested building sites or limited locations where maneuvering the excavator for repositioning is difficult or dangerous. The existing excavator design may restrict operators' ability to execute jobs efficiently.

Some manufacturers have created pivoting excavators to solve this problem. However, these designs often have drawbacks. Implementing a pivoting feature needs bucket removal, which takes time and people. Thus, this method complicates excavation and raises project costs, affecting efficiency and budget.

Innovation is needed to overcome excavator constraints. The revolutionary Reversible Bucket Attachment was created to address these difficulties. The Reversible Bucket Attachment improves efficiency, reduces repositioning limits, and optimizes excavation project cost-effectiveness by adding a bucket pivoting mechanism to machines like excavators.

Excavators are essential heavy machinery in earth-moving applications, but its bucket pivoting inability has caused operational issues. The development of the positionable bucket attachment resolves the aforementioned problems while improving precision, flexibility, and cost-efficiency.

SUMMARY OF THE INVENTION

Embodiments of the present disclosure may include an attachment for a digging machine including an angle coupler mechanism including an upper round plate. Embodiments may also include a lower round plate beneath the upper round plate. Embodiments may also include a cam adapter mechanism secured to a top surface of the upper round plate.

Embodiments may also include a top plate secured at a bottom surface of the top plate to an upper surface of the cam adapter mechanism. Embodiments may also include a pair of upper connection arms attached to an upper surface of the top plate. Embodiments may also include a top connecting arm spanning a distance between the pair of upper connection arms at a distal end of the pair of upper connection arms.

Embodiments may also include a pair of lower connection arms secured to an underside surface of the angle coupler mechanism. In some embodiments, the top connecting arm may be configured to removably secure the attachment to a dipper arm of the digging machine. In some embodiments, the attachment may be configured to facilitate 180-degree pivoting of a bucket along a first axis and a second axis. In some embodiments, the attachment may be adaptable for use with various types of digging machines, including small excavators, backhoes, large excavators, skid-steers, bucket trenchers, wheeled, and tracked models.

In some embodiments, the cam adapter mechanism may include an outer cam plate. Embodiments may also include an inner cam plate. In some embodiments, the pair of lower connection arms may be configured to permit the bucket of the digging machine. In some embodiments, the lower connection arm may include a lower attachment hook. Embodiments may also include a lower retaining hole.

In some embodiments, the attachment may be adaptable for use with various types of digging machines, including small excavators, backhoes, large excavators, skid-steers, bucket trenchers, wheeled, and tracked models. In some embodiments, the angle coupler mechanism may be securely held in place at its center by a lower rotating means. Embodiments may also include a securement against undesired rotation may be achieved by at least two lower securing means.

In some embodiments, the cam adapter mechanism may be securely held in place at its center by an upper rotating means. Embodiments may also include securement against undesired rotation may be achieved by at least two upper securing means. In some embodiments, the outer cam plate and the inner cam plate have a plurality cam alignment apertures configured to permit an adjustment of a cam angle.

In some embodiments, the upper connection arms and the top connecting arms may be attached to the top plate via aa weldment. In some embodiments, the upper connection arms may be configured with upper attachment hooks and upper retaining apertures to facilitate attachment to the dipper arm of the digging machine. In some embodiments, the angle coupler mechanism moves along an angle coupler mechanism travel path for adjusting the bucket angle.

In some embodiments, the cam adapter mechanism moves along a cam adapter mechanism travel path to produce a corresponding bucket cam travel path. In some embodiments, the attachment may be manufactured from cold rolled steel (C1045). Embodiments may also include a given attachment component may be attached to one another attachment component using a weldment or at least one grade eight (8) fastening hardware.

In some embodiments, the attachment may be configured to permit operational features of the digging machine, including a boom, a hydraulic cylinders, an engine, and a cab controls, remain fully operational and unaffected by the attachment. Embodiments may also include a method for utilizing the attachment may include removing the bucket from the dipper arm of the digging machine. Embodiments may also include attaching the bucket reversing attachment to the dipper arm using upper connection arms, upper attachment hooks, and upper retaining holes. Embodiments may also include attaching 110 the bucket to the attachment using lower connection arms, lower attachment hooks, and lower retaining holes.

Embodiments may also include adjusting the bucket angle using the angle coupler mechanism and the bucket cam angle using the cam adapter mechanism. Embodiments may also include utilizing the digging machine with the attachment for various digging advantages. Embodiments may also include optionally repeating steps (d) and (e) for different angles or cam configurations. Embodiments may also include optionally removing the attachment to return the digging machine to its original configuration. In some embodiments, the attachment may be procured from procurement channels such as heavy 120 equipment dealerships, construction equipment retailers, or excavator attachment manufacturers. In some embodiments, the attachment may be designed specifically to be compatible with the intended digging machine's make and model.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
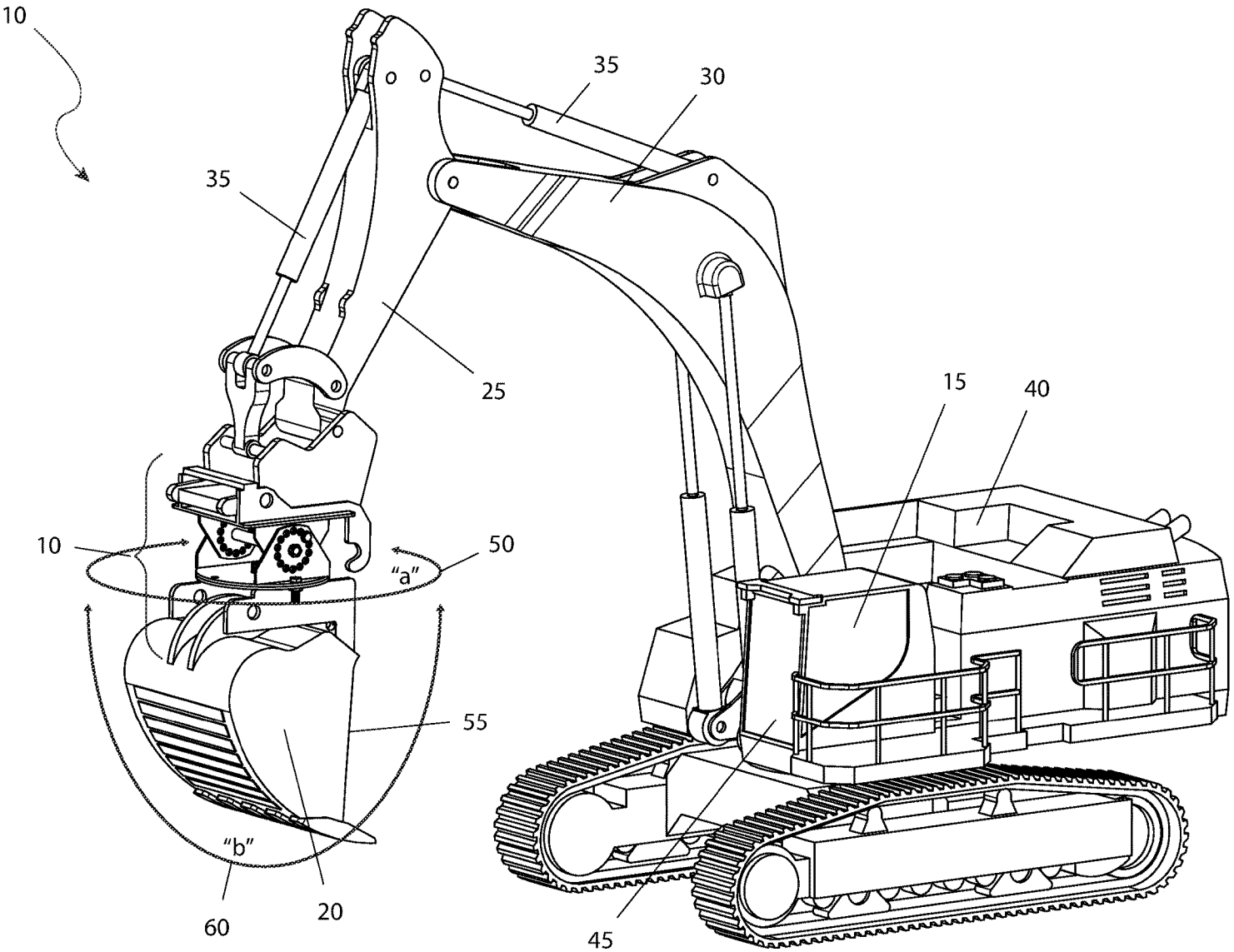
FIG. 1 is a perspective view of the positionable bucket attachment 10, installed on a digging machine 15, according to the preferred embodiment of the present device.

10 positionable bucket attachment
15 digging machine
20 bucket
25 dipper arm
30 boom
35 hydraulic cylinder
40 engine
45 cab control
50 bucket angle travel path "a"
55 bucket opening
60 bucket cam travel path "b"
65 angle coupler mechanism
70 upper round plate
75 lower round plate
80 cam adapter mechanism
85 outer cam plate
90 inner cam plate
95 upper connection arm
100 top plate
105 top connecting arm
110 upper attachment hook
115 upper retaining hole
120 lower connection arm
125 lower attachment hook
130 lower retaining hole
135 lower rotating means
140 lower securing means
145 upper rotating means
150 upper securing means
155 cam adapter mechanism travel path "c"
160 cam alignment hole
165 angle coupler mechanism travel path "d"
170 angle coupler alignment hole

DESCRIPTION OF THE PREFERRED EMBODIMENTS

The best mode for carrying out the device is presented in terms of its preferred embodiment, herein depicted within FIGS. 1 through 11. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one of the referenced items.

1. DETAILED DESCRIPTION OF THE FIGURES

Referring now to FIG. 1, a front view of the positionable bucket attachment 10, installed upon a digging machine 15, according to the preferred embodiment of the present device is disclosed. The positionable bucket attachment 10 (herein also described as the "attachment") 10, provides for an attachment to a digging machine 15 that allows a bucket 20 to be pivoted at different angles along two (2) axes without removing the bucket 20 from the digging machine 15. For sake of illustration, the digging machine 15 is depicted as a small excavator. However, other types of digging machines 15, such as backhoes, large excavators, skid-steers, bucket trenchers, and the like, can also benefit from the teachings of the present device. As such, the use of the attachment 10 on any particular specific type of digging machine 15, including specific manufacturer or model, or wheeled or tracked models, is not intended to be a limiting factor of the present device. The attachment is installed between the bucket 20 and the dipper arm 25, as shown. As such, all of the operational features normally provided by the digging machine 15, by specific components, included but not limited to: the boom 30, the hydraulic cylinders 35, the engine 40, the cab controls 45, and the like, remain operational and do not impact the cab controls 45.

Use of the attachment 10 provides for two (2) additional range of motions of the bucket 20 with reference to the dipper arm 25. The first is bucket angle travel path "a" 50 which allows the bucket opening 55 to face any direction with respect the dipper arm 25 including a complete reverse direction of one-hundred-eighty-degrees (180°) as well as digging to the side. The second is a bucket cam travel path "b" 60 which allows the bucket to dig at different angles than a fixed or conventional bucket 20. Further description of the functionality of the attachment 10 with regards to how it obtains both the bucket angle travel path "a" 50 and the bucket cam travel path "b" 60 at a simultaneous manner will be described herein below.

It is envisioned that the attachment 10 would be manufactured from cold rolled steel (C1045) in a machining, water jet cutting, or similar operation. The various components would be attached to one another as required by welding or with grade eight (8) fastening hardware as described herein below.

Figure 2:
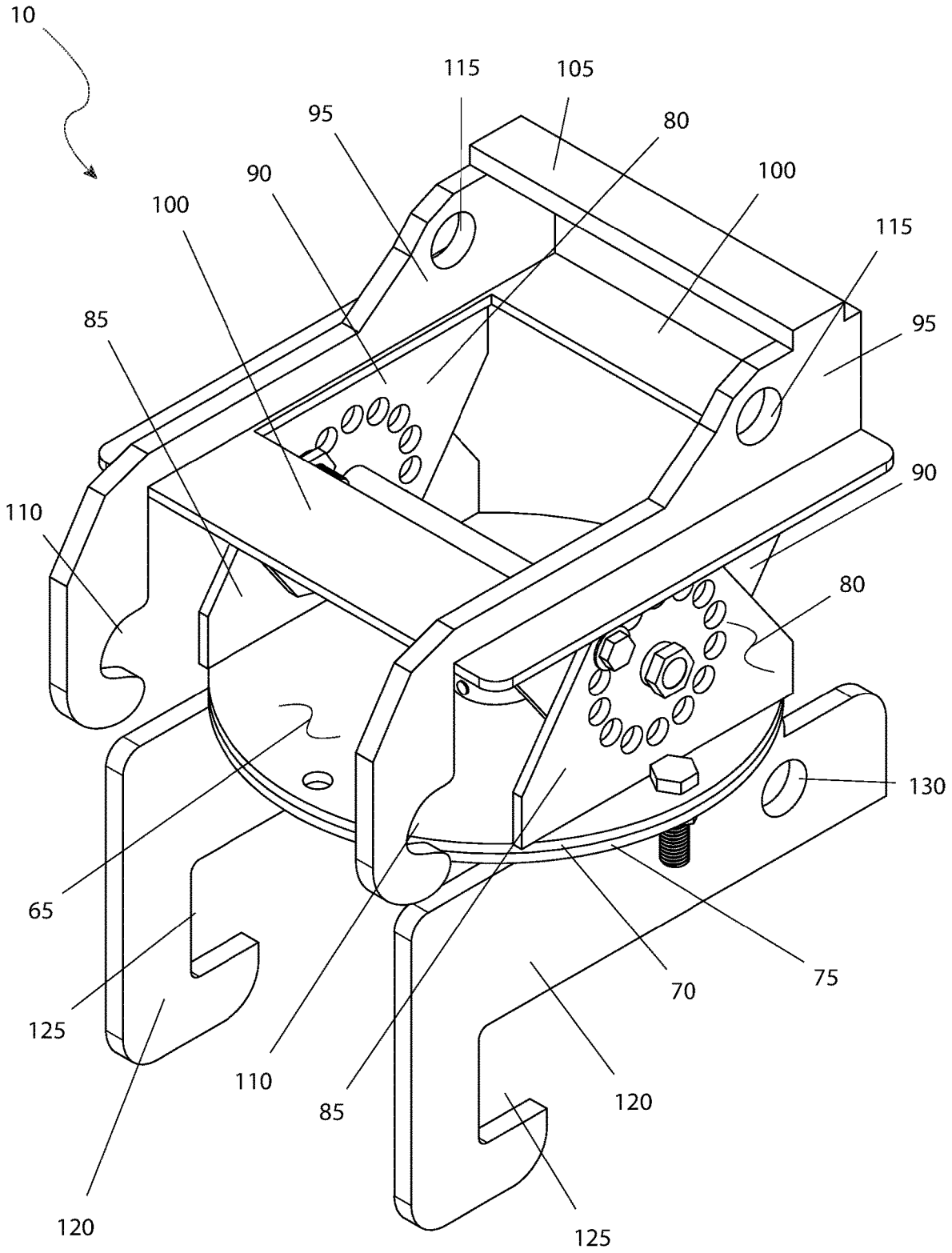
FIG. 2 is a front top perspective view of the positionable bucket attachment 10, according to the preferred embodiment of the present device.
Figure 3:
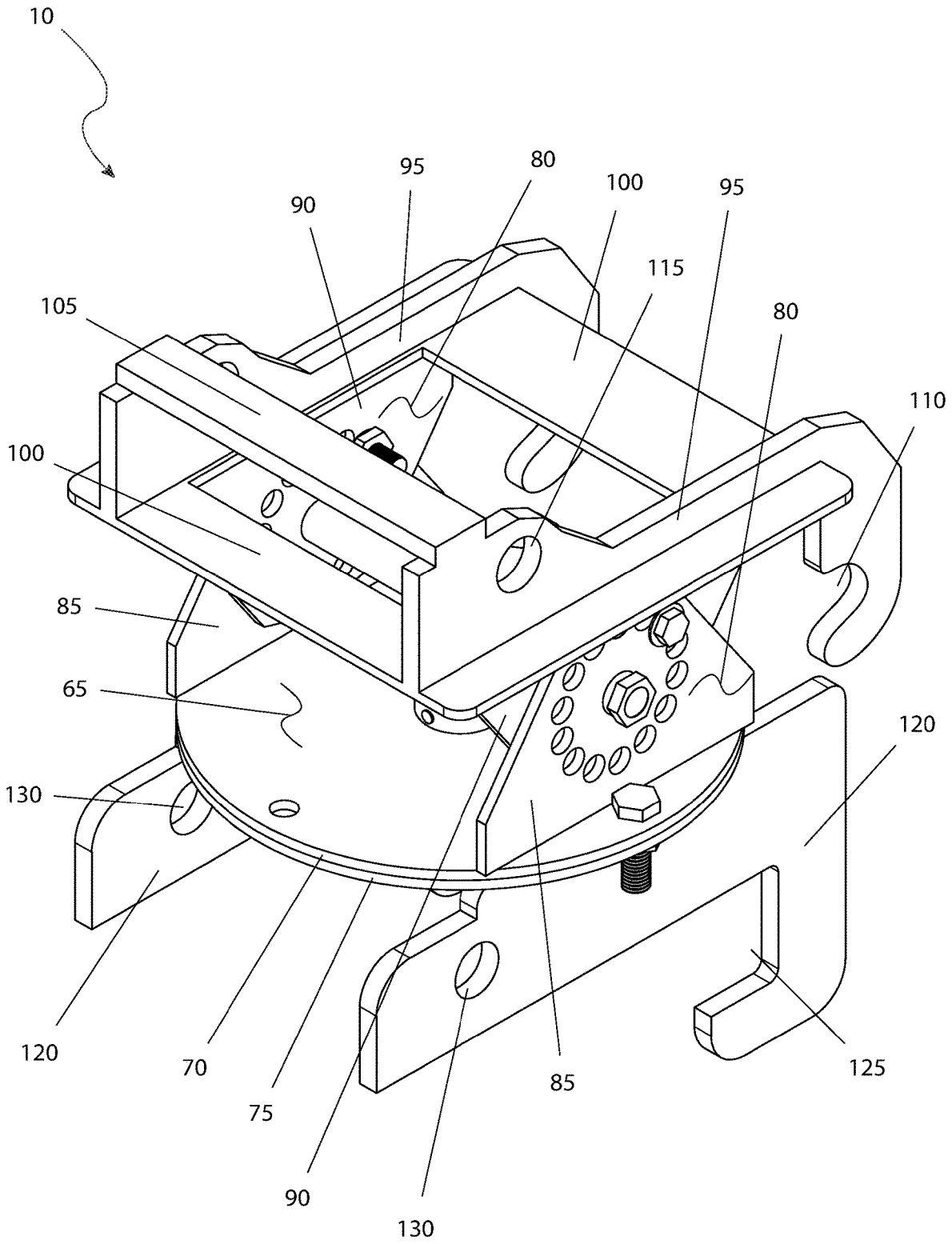
FIG. 3 is a rear top perspective view of the positionable bucket attachment 10, according to the preferred embodiment of the present device.

Referring next to FIG. 2 and FIG. 3, a front top perspective view and a rear top perspective view, respectively, of the attachment 10, according to the preferred embodiment of the present device is depicted. An angle coupler mechanism 65, circular in nature, is provided on the bottom portion of the attachment 10. The angle coupler mechanism 65 consists of an upper round plate 70 and a lower round plate 75. Further detail on the operation of the angle coupler mechanism 65 will be provided herein below. A cam adapter mechanism 80 is then located directly above the angle coupler mechanism 65 and consists of an outer cam plate 85 and an inner cam plate 90 on each side. Further detail on the operation of the cam adapter mechanism 80 will be provided herein below. The attachment 10 is attached to the dipper arm 25 (as shown in FIG. 1) by use of two (2) upper connection arms 95, both of which are connected to a top plate 100 and a top connecting arm 105. The upper connection arms 95 are each provided with an upper attachment hook 110, as well upper retaining holes 115. The exact configuration of the upper connection arms 95, the top plate 100, the top connecting arms 105, the upper attachment hooks 110 and the upper retaining holes 115 would be specific for each make and model of digging machine 15 (as shown in FIG. 1). As such, the specific configuration of the said items is not intended to be a limiting factor of the present device.

The attachment 10 is attached to the bucket 20 (as shown in FIG. 1) by use of two (2) lower connection arms 120, which are connected directly to the lower round plate 75. The lower connection arms 120 are each provided with a lower attachment hook 125 and a lower retaining hole 130. The exact configuration of the lower connection arms 120, the lower attachment hook) 125, and the lower retaining holes 130 would be specific for each make and model of digging machine 15 (as shown in FIG. 1). As such, the specific configuration of the said items is not intended to be a limiting factor of the present device.

Figure 4:
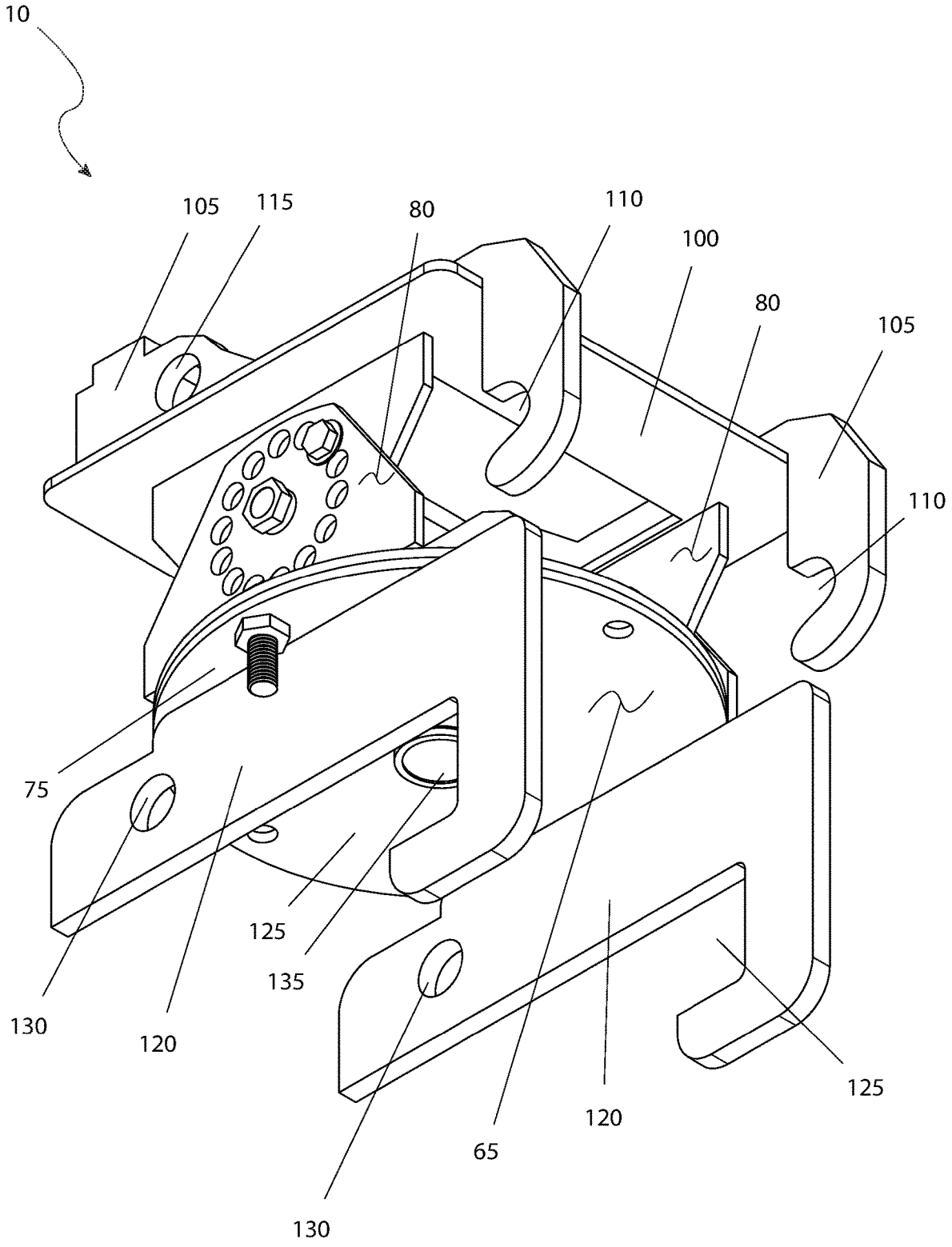
FIG. 4 is a front bottom perspective view of the positionable bucket attachment 10, according to the preferred embodiment of the present device.
Figure 5:
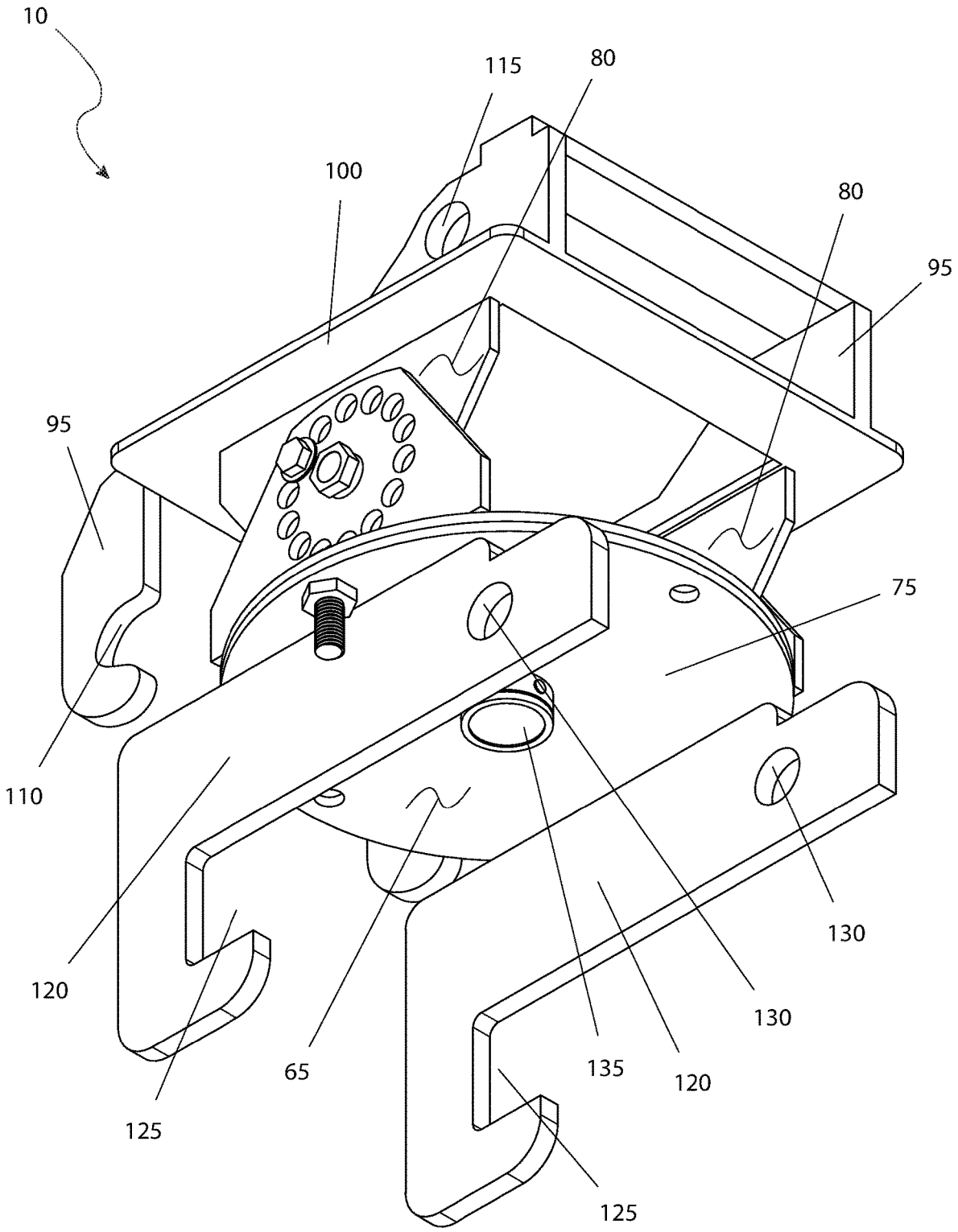
FIG. 5 is a rear bottom perspective view of the positionable bucket attachment 10, according to the preferred embodiment of the present device.

Referring now to FIG. 4 and FIG. 5, is a front bottom perspective view and a rear bottom perspective view, respectively, of the attachment 10, according to the preferred embodiment of the present device is shown. This view more clearly illustrates the angle coupler mechanism 65 and its connection to the lower connection arms 120 via the lower round plate 75, as well as the cam adapter mechanism 80 and its connection to the top plate 100 and the top connecting arms 105. Also, more clearly visible are the upper attachment hooks 110 and the upper retaining holes 115 on the upper connection arms 95, as well as the lower attachment hooks 125 and the lower retaining holes 130 on the lower connection arms 120.

Figure 6:
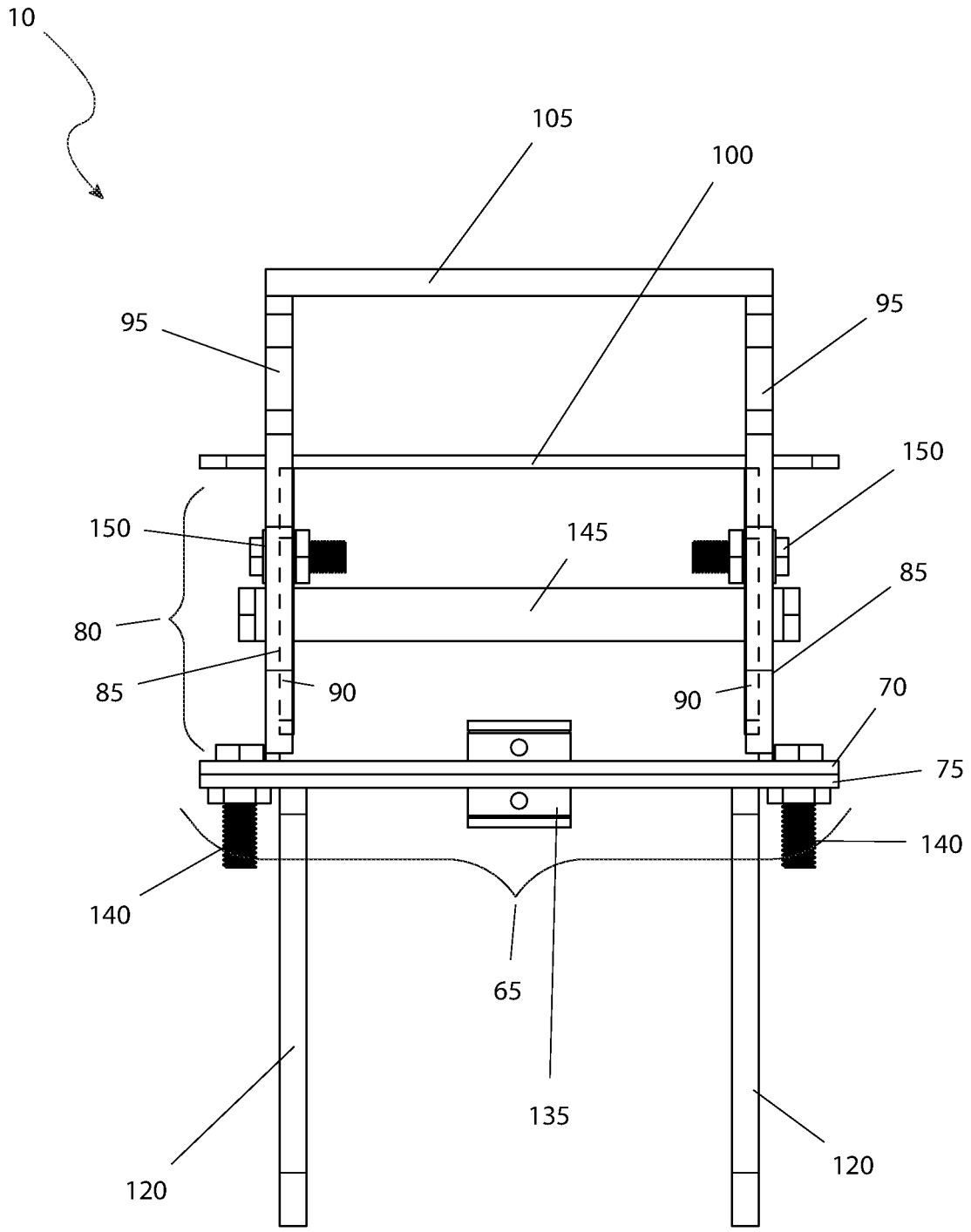
FIG. 6 is a front view of the positionable bucket attachment 10, according to the preferred embodiment of the present device; and, FIG. 7 is a rear view of the positionable bucket attachment 10, according to the preferred embodiment of the present device; and, FIG. 8 is a right-side view of the positionable bucket attachment 10, according to the preferred embodiment of the present device.
Figure 7:
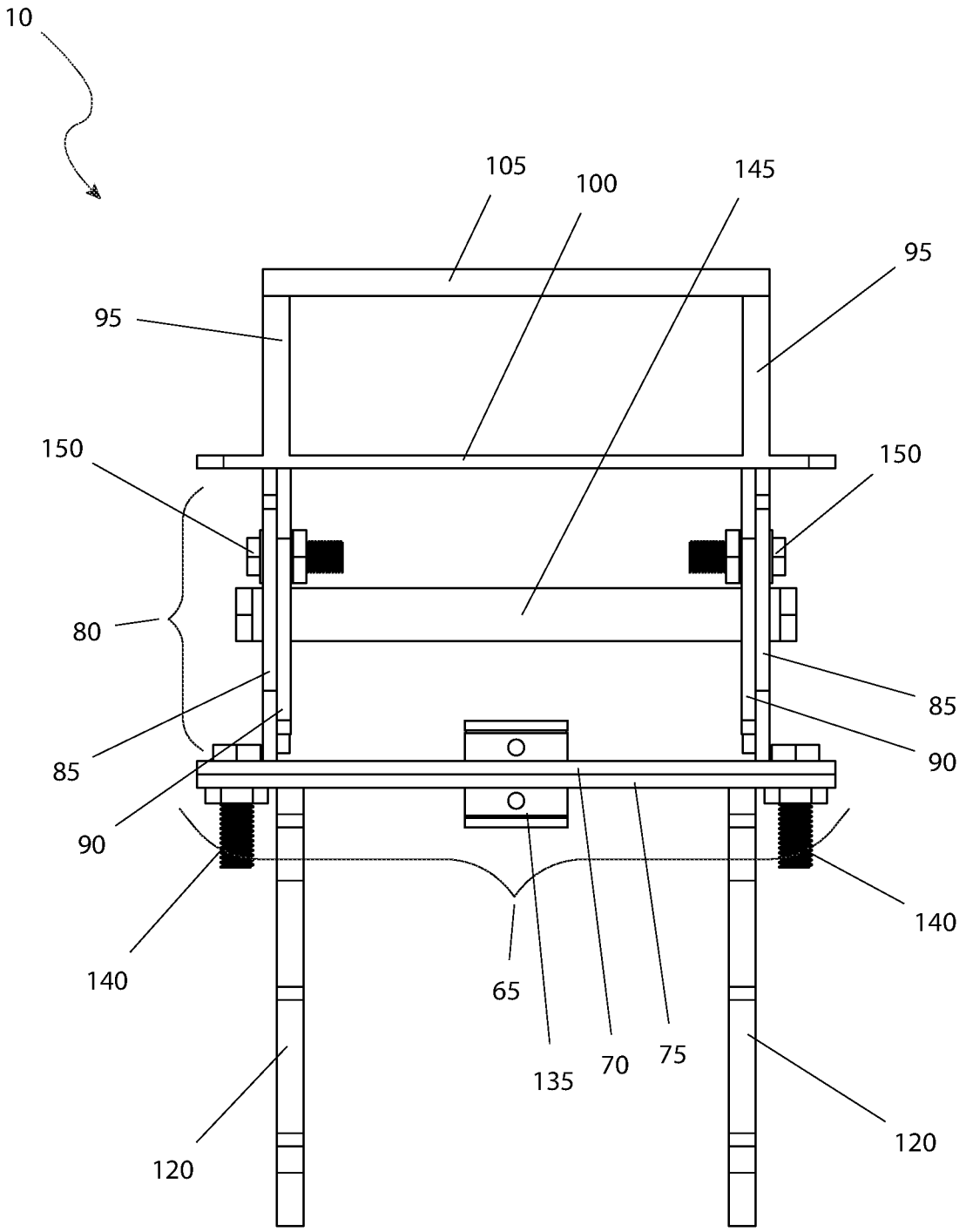

Referring next to FIG. 6 and FIG. 7, a front view and a rear view, respectively, of the attachment 10, according to the preferred embodiment of the present device is disclosed. The angle coupler mechanism 65, including the upper round plate 70 and lower round plate 75, is held captive at its center via a lower rotating means 135, such as a bearing, bolt, rivet, or the like. Securement against undesired rotation is provide by at least two (2) lower securing means 140 such as a bolt (as shown), pins or the like. The lower connection arms 120 are attached to the lower round plate 75 via weldment. The cam adapter mechanism 80, consisting of the outer cam plate 85 and inner cam plate 90 is held captive at its center via an upper rotating means 145 such as an axle, shaft, bearing, bolt, or the like. Securement against undesired rotation is provide by at least two (2) upper securing means 150 such as a bolt (as shown), pins or the like. The cam adapter mechanism 80 is attached to 300 the top plate 100 via weldment. The upper connection arms 95 and the top connecting arms 105 are attached to the top plate 100 via weldment as well.

Figure 8:
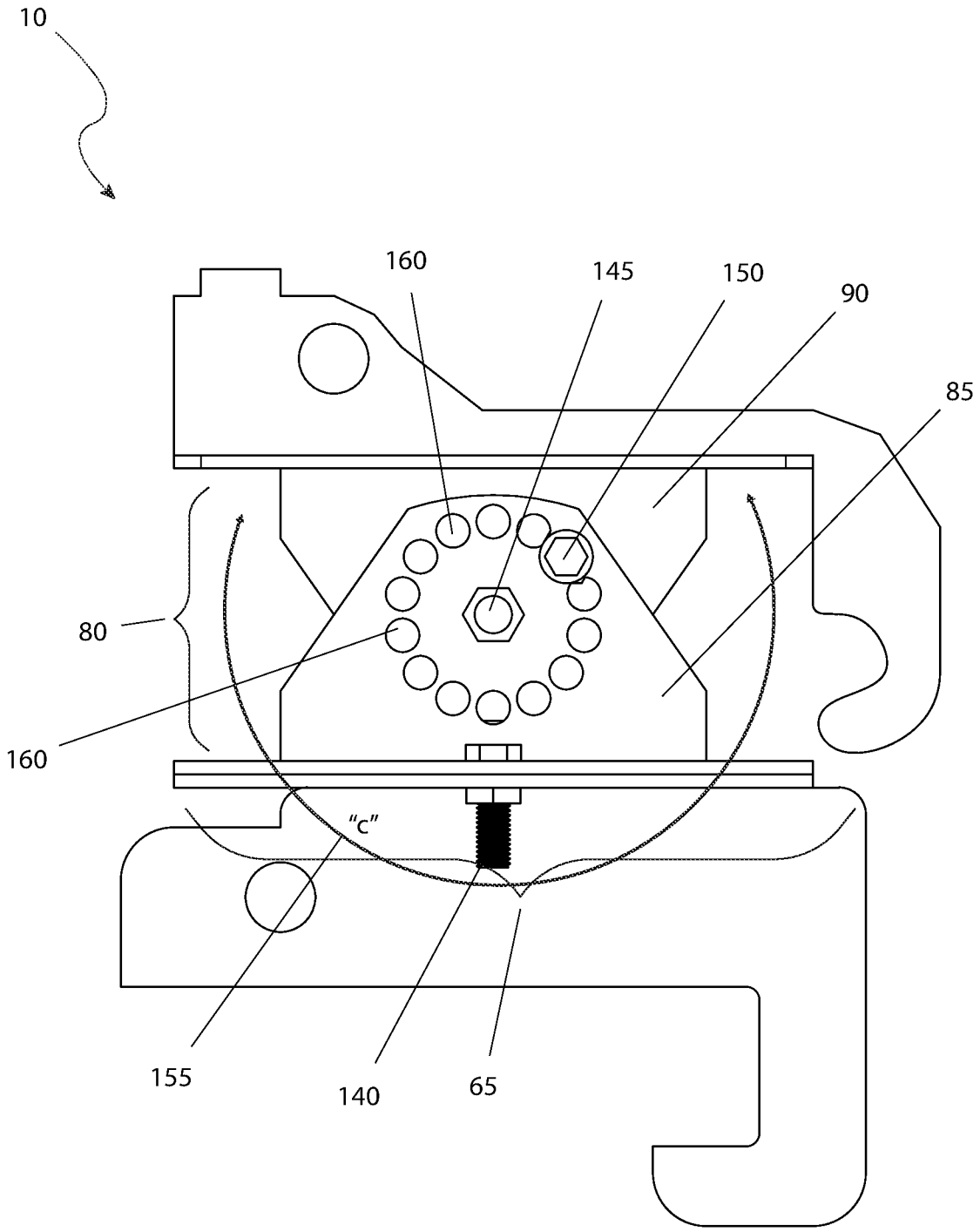
Figure 9:
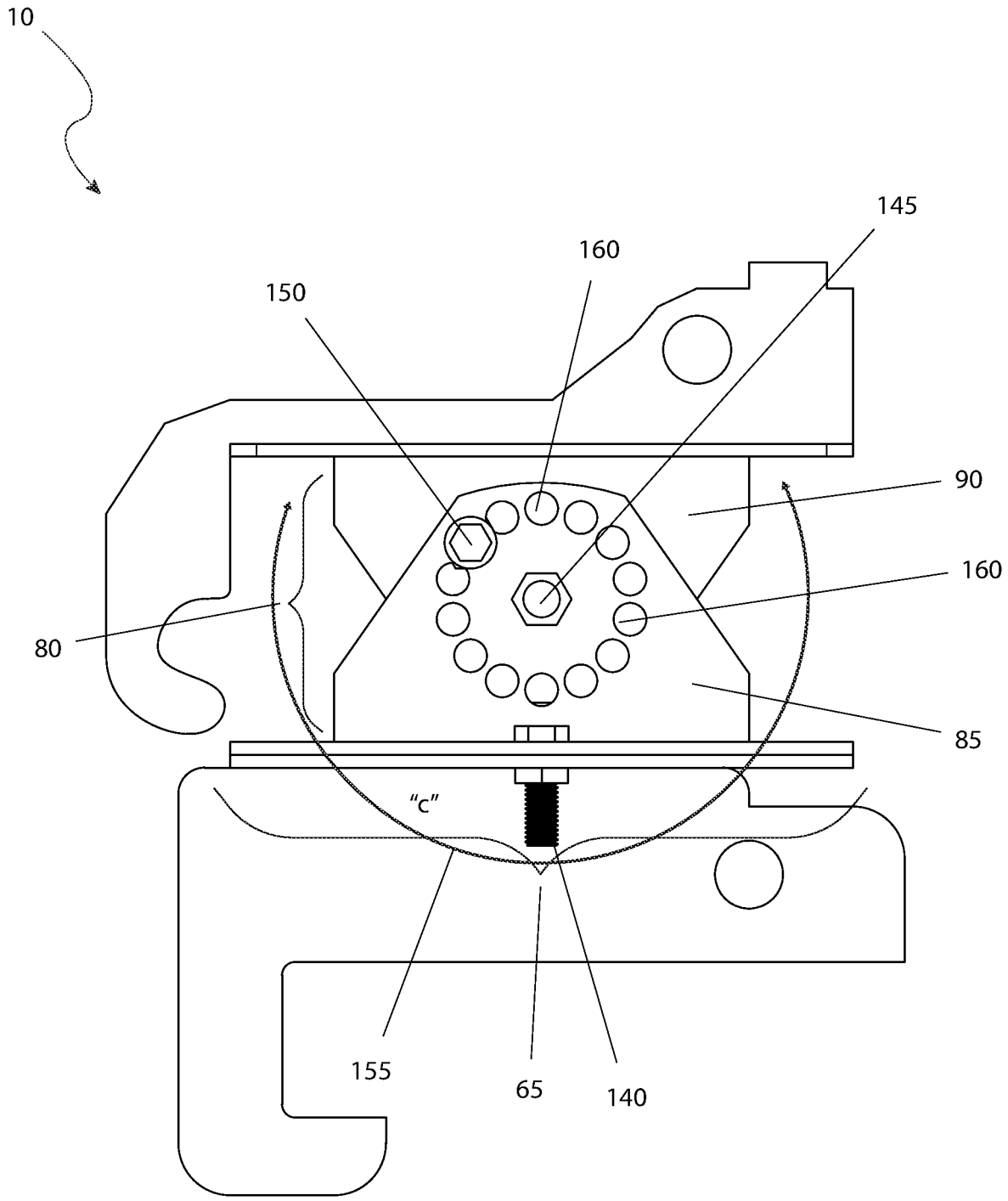
FIG. 9 is a left side view of the positionable bucket attachment 10, according to the preferred embodiment of the present device.

Referring now to FIG. 8 and FIG. 9, a right-side view and a left side view, respectively, of the attachment 10, according to the preferred embodiment of the present device is depicted. One (1) of multiple lower securing means 140 are visible, securing the angle coupler mechanism 65 in position. During adjustment, the outer cam plate 85 and the inner cam plate 90, of the cam adapter mechanism 80, move against one (1) another, centered by the upper rotating means 145 along a cam adapter mechanism travel path "c" 155. The cam adapter mechanism travel path "c" 155 produces the corresponding bucket cam travel path "b" 60 (as shown in FIG. 1). Both the outer cam plate 85 and the inner cam plate 90 are provided with multiple cam alignment holes 160, arranged in a circular path equidistant from the upper rotating means 145. During adjustment, two (2) or more upper securing means 150 are secured through aligned cam alignment holes 160 to produce the desired cam angle.

Figure 10:
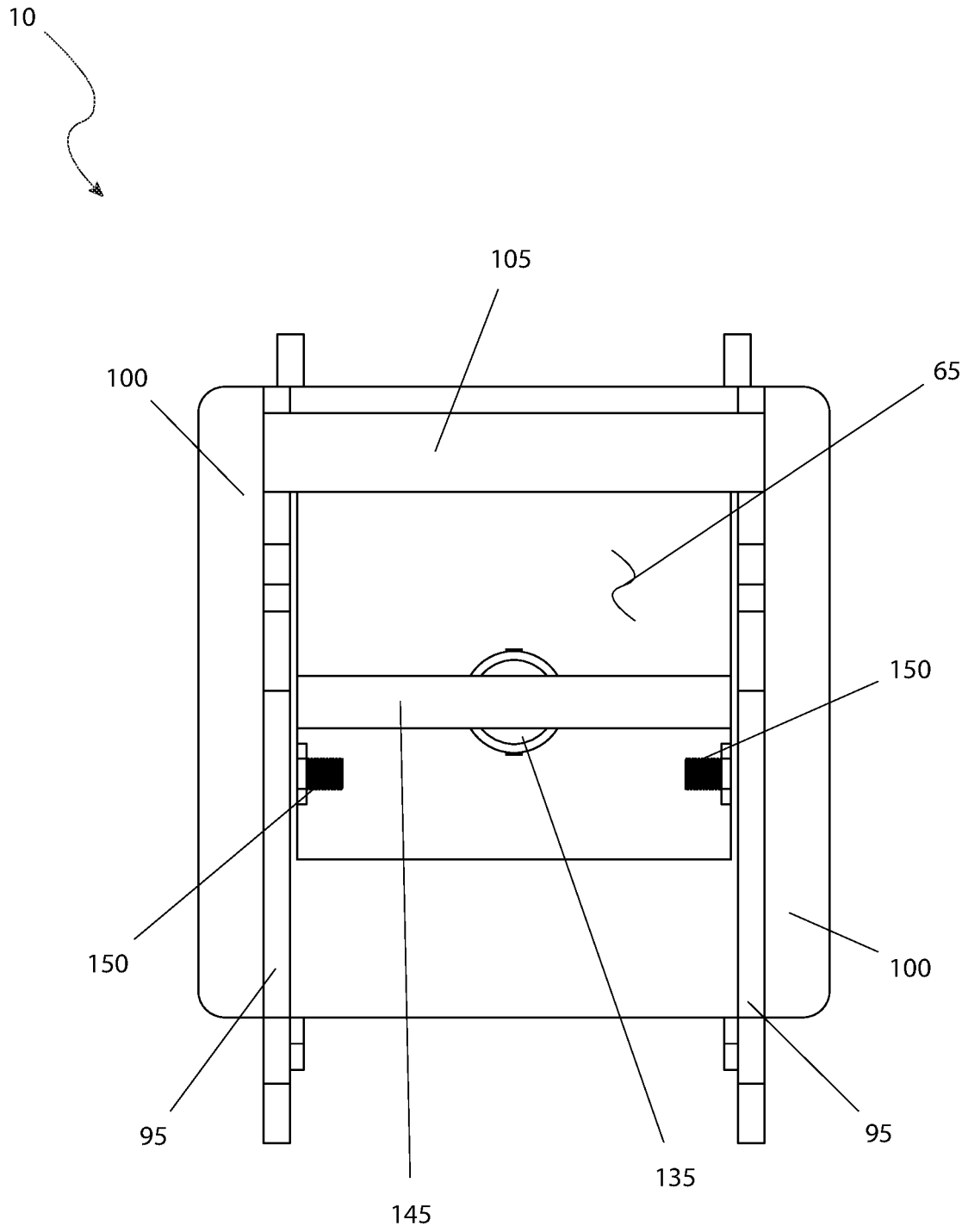
FIG. 10 is a top view of the positionable bucket attachment 10, according to the preferred embodiment of the present device; and, FIG. 11 is a bottom view of the positionable bucket attachment 10, according to the preferred embodiment of the present device.

Referring next to FIG. 10, a top view of the attachment 10, according to the preferred embodiment of the present device is shown. The angle coupler mechanism 65 and its center-mounted lower rotating means 135 is visible. Likewise, the upper rotating means 145 and the upper securing means 150 are visible as part of the cam adapter mechanism 80 (as shown in FIGS. 2, 3, 4, and 5). The top plate 100 and connecting top connecting arms 105 form a secure mounting means for the upper connection arms 95.

Figure 11:
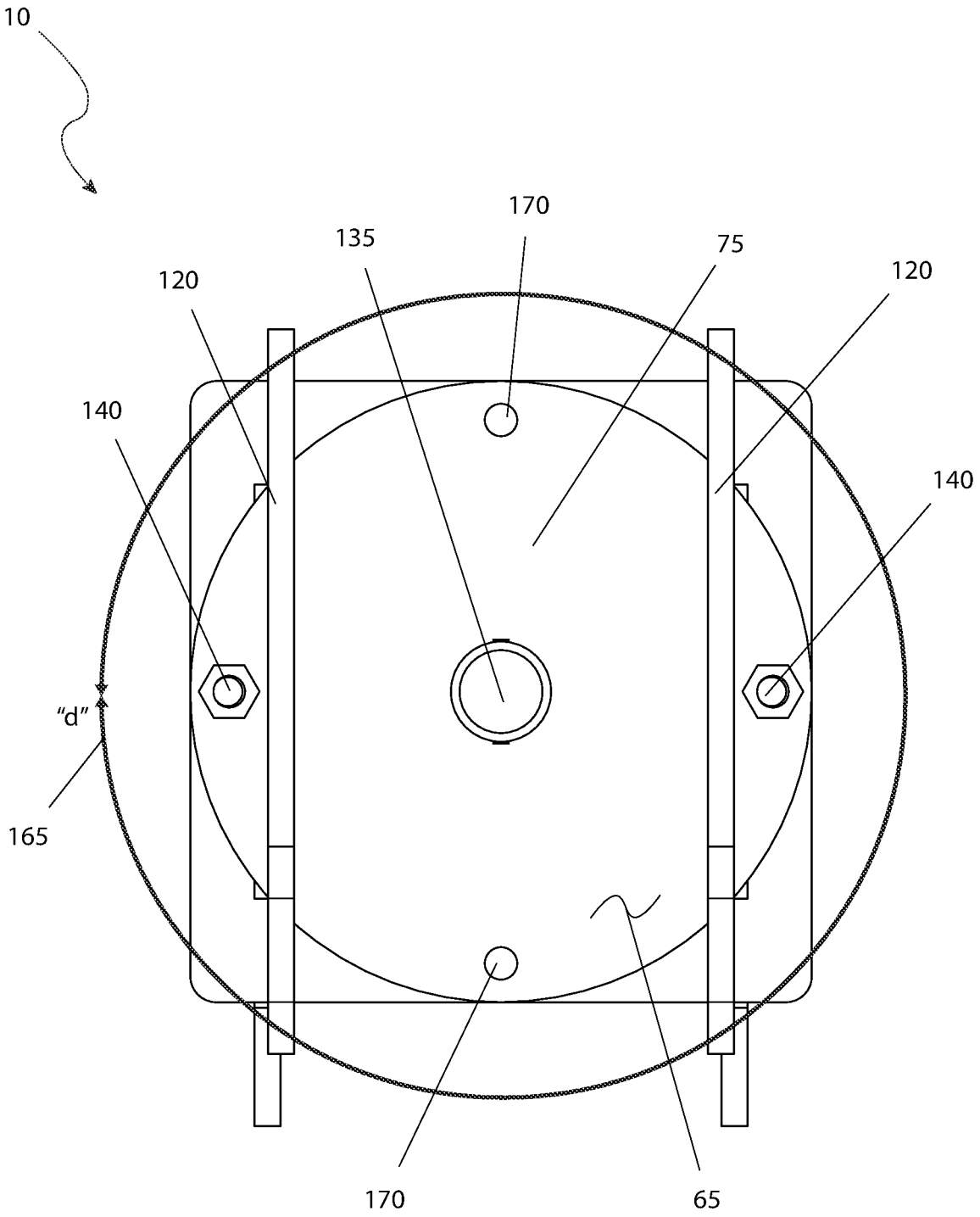

Referring to FIG. 11, a bottom view of the attachment 10, according to the preferred embodiment of the present device is disclosed. The lower round plate 75 of the angle coupler mechanism 65 is shown in a physical connection to the lower connection arms 120. The angle coupler mechanism 65 moves about the lower rotating means 135 along an angle coupler mechanism travel path "d" 165. The angle coupler mechanism 330 travel path "d" 165 correspond to the bucket angle travel path "a" 50 (as shown in FIG. 1). The lower round plate 75 and the upper round plate 70 (as shown in FIGS. 2, 3, 4, and 5) are each provided with multiple angle coupler alignment holes 170 (here only two (2) of four (4) are shown, due to illustrative limitations). Once properly positioned, the angle coupler mechanism 65 is secured in place by at least two (2) lower securing means 140.

2. OPERATION OF THE PREFERRED EMBODIMENT

The preferred embodiment of the present device can be utilized by the common user in a simple and effortless manner with little or no training. It is envisioned that the attachment 10 would be constructed in general accordance with FIG. 1 through FIG. 11. The user would procure the attachment 10 from conventional procurement channels such as a heavy equipment dealership, a construction equipment retailer, manufacturers' dealerships, official distributors, excavator attachment manufacturers, local equipment rental companies or the like. Special attention would be paid to the specific design of the attachment 10 such that it will be compatible with the intended digging machine 15 that it is intended to be used with.

After procurement and prior to utilization, the bucket 20 would be first removed from the dipper arm 25 of the digging machine 15. The attachment 10 would be attached to the dipper arm 25 using the top connecting arms 105, the upper attachment hooks 110, and the upper retaining holes 115. The bucket 20 would be attached to the attachment 10 using the lower attachment hooks 125 and the lower retaining holes 130. The cam angle of the bucket, as defined by the bucket cam travel path "b" 60, would be adjusted by use of the cam adapter mechanism 80, via mechanical manipulation of the outer cam plate 85 and the inner cam plate 90 centered by the upper rotating means 145 along a cam adapter mechanism travel path "c" 155 and secured by multiple upper securing means 150. The angle of the bucket 20 would be adjusted by mechanical manipulation of the angle coupler mechanism 65 by movement of the upper round plate 70 against the lower round plate 75 centered about the lower rotating means 135 and secured by multiple lower securing means 140. At this point in time, the attachment 10 is ready for use.

During utilization of the attachment 10, the cab controls 45 of the digging machine 15 would be used in a conventional manner. However, the bucket 20 is rotated by the angle coupler mechanism 65 and cammed by the cam adapter mechanism 80 to provide different digging advantages when compared to a conventional fixed bucket 20. As such, the benefits of the attachment 10 are viewed as advantageous when performing complex excavations or excavations where maneuverability of the digging machine 15 is restricted. Should different angles or cam configurations of the bucket 20 during the excavation process, the above process may be repeated as required.

After use of the attachment 10, it may be left in place, or removed, thus placing the digging machine 15 and corresponding bucket 20 in its original configuration with no permanent modifications.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. An attachment for a digging machine, the attachment configured to be installed between a dipper arm of the digging machine and a bucket, the attachment comprising:

an angle coupler mechanism including an upper round plate and a lower round plate disposed beneath the upper round plate, the upper round plate and the lower round plate being rotatable relative to one another about a lower rotating means, the upper round plate including a first plurality of angle coupler alignment holes and the lower round plate including a second plurality of angle coupler alignment holes, the first plurality of angle coupler alignment holes and the second plurality of angle coupler alignment holes being arranged to be selectively alignable with one another; and, at least two lower securing means selectively receivable through aligned ones of the angle coupler alignment holes to secure a selected rotational position of the angle coupler mechanism;

a cam adapter mechanism secured to a top surface of the upper round plate, the cam adapter mechanism including an outer cam plate and an inner cam plate that are movable relative to one another about an upper rotating means, the outer cam plate and the inner cam plate including a plurality of cam alignment holes arranged to be selectively alignable with one another, and at least two upper securing means selectively receivable through aligned ones of the cam alignment holes to secure a selected cam configuration of the cam adapter mechanism;

a top plate secured to the cam adapter mechanism; upper connection structure coupled to the top plate and configured to removably secure the attachment to the dipper arm; and lower connection structure coupled to the lower round plate and configured to secure the bucket to the attachment; and, wherein the selected rotational position of the angle coupler mechanism defines a bucket angle travel path and the selected cam configuration of the cam adapter mechanism defines a bucket cam travel path.

2. The attachment of claim 1, wherein the lower rotating means comprises a bearing, bolt, or rivet and the upper rotating means comprises an axle, shaft, bearing, or bolt, wherein the lower securing means and the upper securing means comprise bolts or pins, and wherein the attachment is configured such that operational features of the digging machine including a boom, one or more hydraulic cylinders, an engine, and cab controls remain operational and unaffected by installation and use of the attachment.

* * * * *